US008073684B2

(12) United States Patent
Sundareson

(10) Patent No.: US 8,073,684 B2
(45) Date of Patent: Dec. 6, 2011

(54) APPARATUS AND METHOD FOR AUTOMATIC CLASSIFICATION/IDENTIFICATION OF SIMILAR COMPRESSED AUDIO FILES

(75) Inventor: Prabindh Sundareson, Madurai (IN)

(73) Assignee: Texas Instruments Incorporated, Dallas, TX (US)

( * ) Notice: Subject to any disclaimer, the term of this patent is extended or adjusted under 35 U.S.C. 154(b) by 1638 days.

(21) Appl. No.: 10/424,393

(22) Filed: Apr. 25, 2003

(65) Prior Publication Data

US 2004/0215447 A1 Oct. 28, 2004

(51) Int. Cl.
*G10L 19/00* (2006.01)
*G10L 11/00* (2006.01)

(52) U.S. Cl. ..... 704/200.1; 704/270; 704/231

(58) Field of Classification Search ..... 704/200.1, 704/231, 270

See application file for complete search history.

(56) References Cited

U.S. PATENT DOCUMENTS 6,370,504 B1 * 4/2002 Zick et al. ..... 704/251
6,542,869 B1 * 4/2003 Foote ..... 704/500
6,813,600 B1 * 11/2004 Casey et al. ..... 704/200.1

* cited by examiner

*Primary Examiner* — Angela A Armstrong
(74) *Attorney, Agent, or Firm* — Mirna Abyad; Wade J. Brady, III; Frederick J. Telecky, Jr.

(57) ABSTRACT

An audio file is divided into frames in the time domain and each frame is compressed, according to a psycho-acoustic algorithm, into file in the frequency domain. Each frame is divided into sub-bands and each sub-band is further divided into split sub-bands. The spectral energy over each split sub-band is averaged for all frames. The resulting quantity for each split sub-band provides a parameter. The set of parameters can be compared to a corresponding set of parameters generated from a different audio file to determine whether the audio files are similar. In order to provide for the higher sensitivity of the auditory response, the comparison of individual split sub-bands of the lower order sub-bands can be performed. Selected constants can be used in the comparison process to improve further the sensitivity of the comparison. In the side-information generated by the psycho-acoustic compression, data related to the rhythm, i.e., related percussive effects, is present. The data known as attack flags can also be used as part of the audio frame comparison.

18 Claims, 5 Drawing Sheets

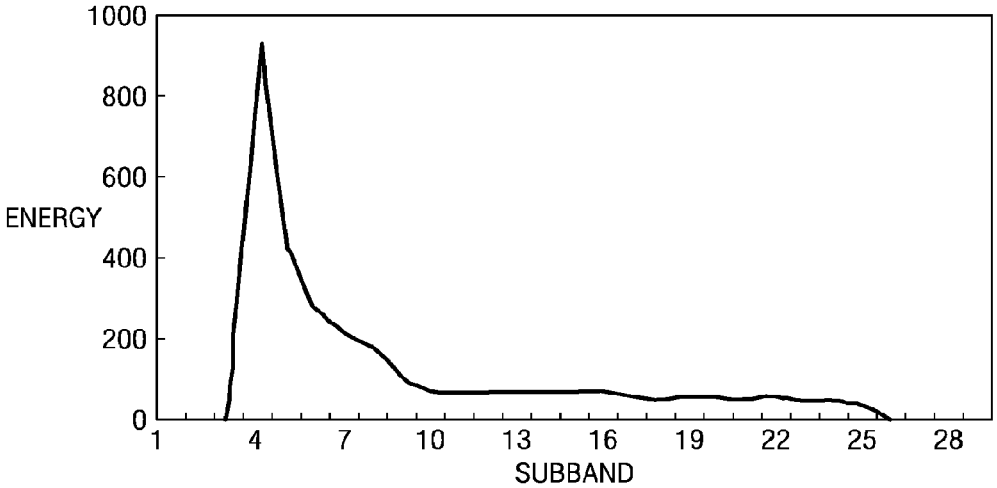

*FIG. 4*

| PERCEPTUAL FEATURE | EXTRACTED FEATURE | EXAMPLE |
|---|---|---|
| PITCH | FUNDAMENTAL FREQUENCY (MAINLY FOR VOICE) | MALE/FEMALE SPEECH |
| "BRIGHT" (TIMBRE) | SLOPE OF ATTACKS | DIFFERENT KINDS OF MUSICAL INSTRUMENTS |
| "RHYTHMIC" | ZERO CROSSING RATE | PERCUSSIVE SOUNDS |
| HEAVY" | MEAN AMPLITUDE | ROCK/POP |
| COLOUR | HIGH FREQUENCY ENERGY | LOTS OF INSTRUMENTS |
| MUSIC/SPEECH DISTINCTION | AVERAGE (CENTROID), HARMONICITY | - |

*FIG. 5*

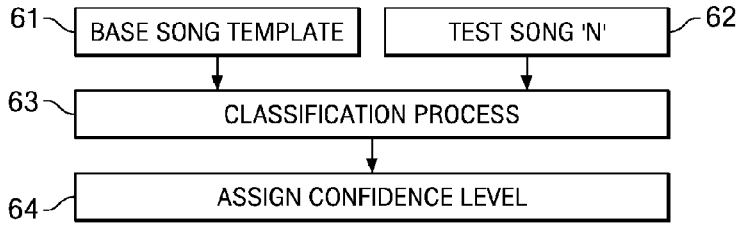
FIG. 6
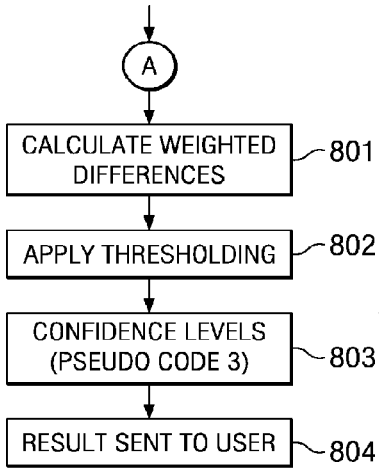
FIG. 8
FIG. 9
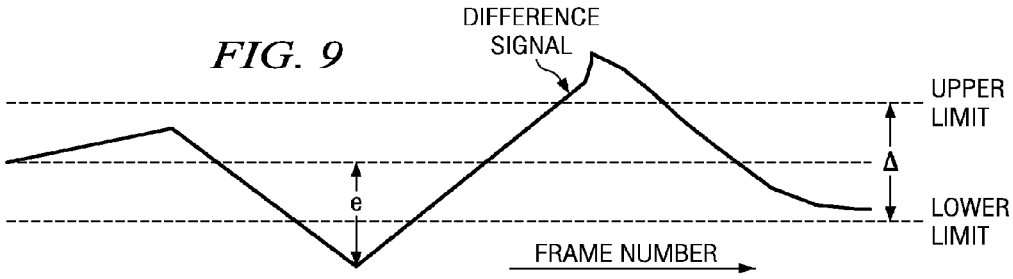

| CATEGORIES | POP | ROCK | CLASSICAL | JAZZ |
|---|---|---|---|---|
| POP | 90% | 30% | 30% | 30-70% |
| ROCK | - | 90% | 20% | 20% |
| CLASSICAL | - | - | 90% | 40% |
| JAZZ | - | - | - | 90% |

APPARATUS AND METHOD FOR AUTOMATIC CLASSIFICATION/IDENTIFICATION OF SIMILAR COMPRESSED AUDIO FILES

BACKGROUND OF THE INVENTION

1. Field of the Invention

This invention relates generally to audio files that have been processed using compression algorithms, and, more particularly, to a technique for the automatic classification of the compressed audio file contents.

2. Background of the Invention

With advances in auditory masking theory, quantization techniques, and data compression techniques, lossy compression of audio files has become the processing method of choice for the storage and streaming of the audio files. Compression schemes with various degrees of complexity, compression ratios and quality have evolved. The availability of these compression schemes has driven and been driven by the internet and portable audio devices. Several large data bases of compressed audio music files exist on the internet (e.g., from online stores). On a smaller scale, compressed audio music files are present on computers and portable devices around the globe. While classification schemes exist for MIDI music files and speech files, few schemes address the problem of identification and retrieval of audio content from compressed music database files. One attempt at classification of compressed audio files is the MPEG-7 standard. This standard is directed to providing a set of low level and high level descriptors that can facilitate content indexing and retrieval.

Referring to FIG. 1, a generalized block diagram of apparatus 10 for performing audio file compression schemes is shown. The raw audio data file is applied to time domain to frequency domain transformation unit 11 and to the psycho-acoustic model unit 12. The psycho-acoustic model unit 12 provides the mechanism for processing the raw data that includes assumptions regarding how audio input is perceived by human beings. Output signals from the psycho-acoustic model unit 12 are applied to the time domain/frequency domain transformation unit 11 and to a quantization unit 15. Output signals from the time domain/frequency domain transformation unit 11 are also applied to the quantization unit 15. The output signals of the quantization unit 15 are the compressed audio files. The time domain/frequency domain transformation unit 11 transforms the raw data file in the time domain to a data file in the frequency domain. The frequency domain data is quantized in the quantization unit 15 based on masking information provided by the psycho-acoustic unit 12. The psycho-acoustic unit 12 also determines the time domain/frequency domain transformation unit 11 resolution depending on the characteristics of the input signals. As a result of the apparatus shown in FIG. 1, an audio file receives two levels of compression. The first level of compression results from the selective retention of only the important audio file components as determined by the psycho-acoustic model. The second level of compression is a file compression of the file resulting from the psycho-acoustic compression, the second level of compression shrinking the file to reduce the amount of storage space. The second level of compression typically includes the Huffman coding.

In the past, centroid and energy levels of the data in the frequency domain of MPEG (Moving Picture Experts Group) encoded files along with nearest neighbor classifiers have been used as descriptors. This system has been further enhanced by including a framework for discrimination of compressed audio files based on semi-automatic methods, the system including the ability of the user to add more audio features. In addition, a classification for MPEG1 audio and television broadcasts using class (i.e., silence, speech, music, applause based segmentation) has been proposed. A similar proposal compares GMM (Gaussian Mixture Models) and tree-based VQ (Vector Quantization) descriptors for classifying MPEG encoded data.

The data in the compressed audio files are in the form of frequency magnitudes. The entire range of frequencies audible to the human ear is divided into sub-bands. Thus the data in the compressed file is divided into sub-bands. Specifically, in the MP3 format, the data is divided into 32 sub-bands. (In addition in this format, each sub-band can be further divided into 18 frequency bands referred to as split sub-bands). Each sub-band can be treated according to its masking capabilities. (Masking capability is the ability of a particular frame of audio data to mask the audio noise resulting from compression of the data. For example, instead of encoding a signal with 16 bits, 8 bits can be used, however, resulting in additional noise.) Audio algorithms also provide flags for detection of attacks in a music piece. Because an energy calculation is already performed in the encoder, the flagging of attacks can be used as an indication of rhythm, e.g., drum beats. Drum beats form the background music in most titles in music data bases. Most audiences tend to identify the characteristics of drum beats as rhythm. Because rhythm plays an important role in identifying any music, the characteristics of compression algorithms in flagging attacks is important. In present encoders, including MP3, pre-echo conditions (i.e., a condition resulting from analyzing the audio in fixed blocks rather than a long stream) are handled by switching the window to a shorter window rather than one that would otherwise be used. In some encoders, such as ATRAC (Adaptive Transform Acoustic Coding,) pre-echo is handled by gain control in the time domain. In AAC (Advanced Audio Coding) encoders, both methods are used. Referring to FIG. 2, the attack flags in a piece of music with a periodic drum beat are illustrated. In FIG. 3, the attack flags for music pieces with the human voice but no drum beat and for music pieces such as a violin concert without drum beats in the back ground are illustrated.

Referring to FIG. 4, an example of sub-band data from the frequency domain is illustrated. This sample is taken from an MP3 file encoded at 44 kHz, 128 kbps.

The techniques implemented and proposed for classifying compressed audio files in the related art have variety of shortcomings associated therewith. The computational complexity is high in most of the schemes of the related art. Therefore, these schemes may be applicable only for music file servers and not for generic internet applications. The schemes typically are not directly applicable to compressed audio files. In addition, most of the schemes decode the compressed data back to the time domain and apply techniques that have been proven in the time domain. Thus, these schemes do not take advantage of the features and parameters already available in the compressed files. In the schemes that do make use of data in the compressed format, the frequency data alone is used and not the information available as side-information descriptors. The use of side-information descriptors eliminates a large amount of computation.

A need has therefore been felt for apparatus and an associated method having the feature that the identification and classification of compressed audio files can be implemented. It would be a further feature of the apparatus and associated method to provide for the classification and identification of compressed audio files in a relatively short period of time. It would be a still further feature of the apparatus and associated method to provide for the classification and identification of compressed audio files at least partially using parameters generated as a result of compressing the audio file. It would be a still further feature of the apparatus and associated method to generate parameters describing a compressed audio file. It would be a more particular feature of the apparatus and associated method to compare a compressed reference audio file with at least one other compressed audio file. It would be yet another particular feature of the present invention to compare parameters generated from a first compressed audio file with parameters from a second compressed audio file.

SUMMARY OF THE INVENTION

The aforementioned and other features are accomplished, according to the present invention, by classifying each audio file by means of a group of parameters. The original audio file is divided into frames and each frame is compressed by means of a psycho-acoustic algorithm, the resulting files being in the frequency domain. The resulting frames are divided into frequency sub-bands. A parameter identifying the average spectral power for all the frames is generated. The set of parameters for all of the bands can be used to classify the audio file and to compare the audio file with other audio files. To improve the effectiveness of the parameters, the sub-bands can be further divided into split sub-bands. In addition, because the auditory response is more sensitive at lower frequencies, the split sub-band spectral power for at least one of the lowest order sub-bands can be separately used as parameters. These parameters can be used in conjunction with corresponding parameters for a second audio file to determine the similarity between the audio files by taking the difference between the parameters. The process can be further refined by providing incorporating weighting factors in the calculation. The psycho-acoustic compression typically generates side-information relating to the rhythm of a musical audio file. This side-information can be used in determining the similarity between two files.

Other features and advantages of present invention will be more clearly understood upon reading of the following description and the accompanying drawings and the claims.

BRIEF DESCRIPTION OF THE DRAWINGS

FIG. 4 is an example of a frame of frequency domain data taken from an encoded file according to the prior art.

FIG. 5 illustrates the relationship between the perceived characteristics of an audio performance and the features that can be extracted from the audio file using signal processing techniques.

FIG. 6 illustrates the general process for identifying and classifying an audio compressed file.

FIG. 8 is a flow chart illustrating the classification process for compressed audio files according to the present invention.

FIG. 9 illustrates some of the parameters used in the pseudo code according to the present invention.

DESCRIPTION OF THE PREFERRED EMBODIMENT

1. Detailed Description of the Figures

FIG. 1, FIG. 2, FIG. 3, and FIG. 4 have been described with respect to the related art.

Referring to FIG. 5, the features of an audio file that can be related to parameters extracted from the audio file by signal processing techniques are illustrated. The pitch is determined by the fundamental frequency of the performance and is the result of speech. The timbre or "brightness" of an audio performance can be determined by the slope of the attacks and can differentiate different musical instruments. The rhythm of an audio performance can be characterized by the zero crossing rate characteristic and can be produced by percussive sounds. A characteristic referred to "heavy" in a performance can be characterized by the mean amplitude of the audio file and can characterize rock or pop performances. The "color" of audio performance can be characterized by the high frequency energy and is produced by a variety of musical instruments. The music speech distinction can be characterized by the average (centroid) amplitude and by the harmonic content.

Referring now to FIG. 6, the process for identifying and classifying a compressed audio file is illustrated using songs as an example. The song to which the compressed audio file is to be compared is analyzed and a template generated in step 61. The compressed audio file is accessed in step 62. In step 63, the classification based on a comparison of the base song template and the test song is performed. Based on this comparison, a confidence level is generated in step 63. The confidence level is a measure of the similarity of the base song and the test song.

Figure 1:
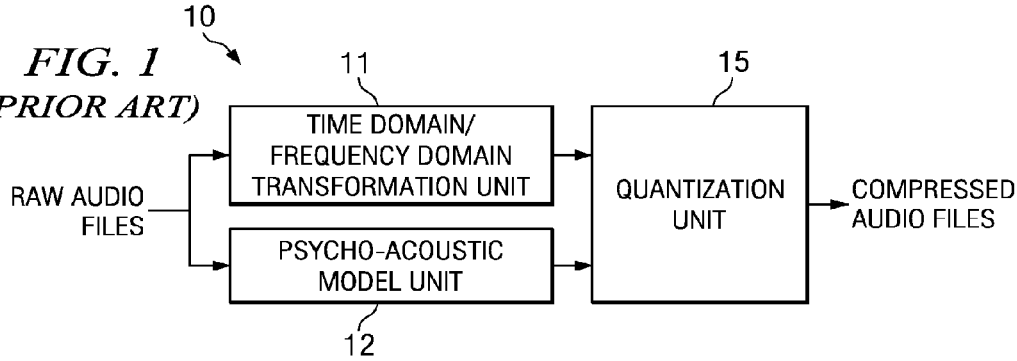
FIG. 1 (PRIOR ART)
FIG. 1 is a block diagram illustrating a generalized compression scheme according to the prior art.
Figure 2:
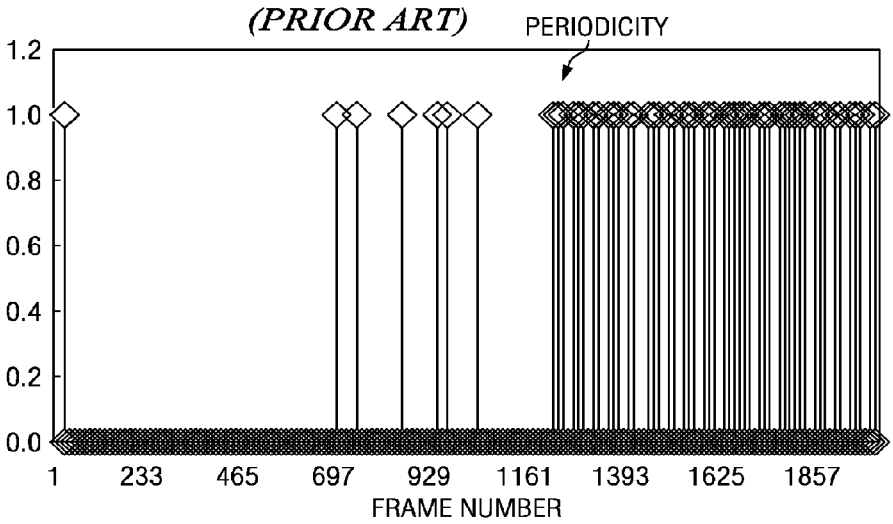
FIG. 2 (PRIOR ART)
FIG. 2 illustrates the attack flags is a piece of music with a periodic drum beat according to the prior art.
Figure 3:
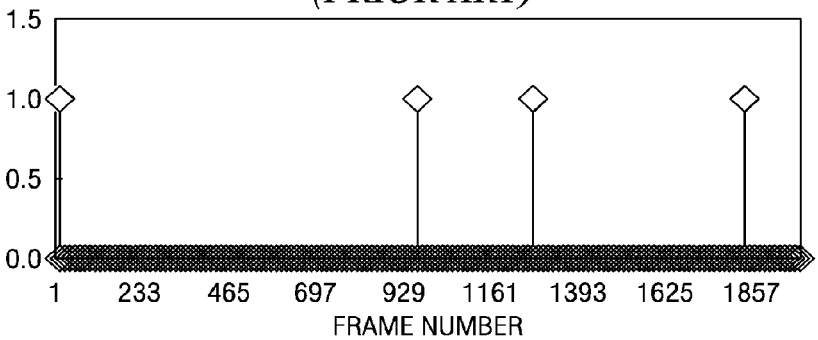
FIG. 3 (PRIOR ART)
FIG. 3 illustrates the attack flag is a piece of music with a human voice or a violin concert, but without a drum beat in the background according to the prior art.
Figure 7:
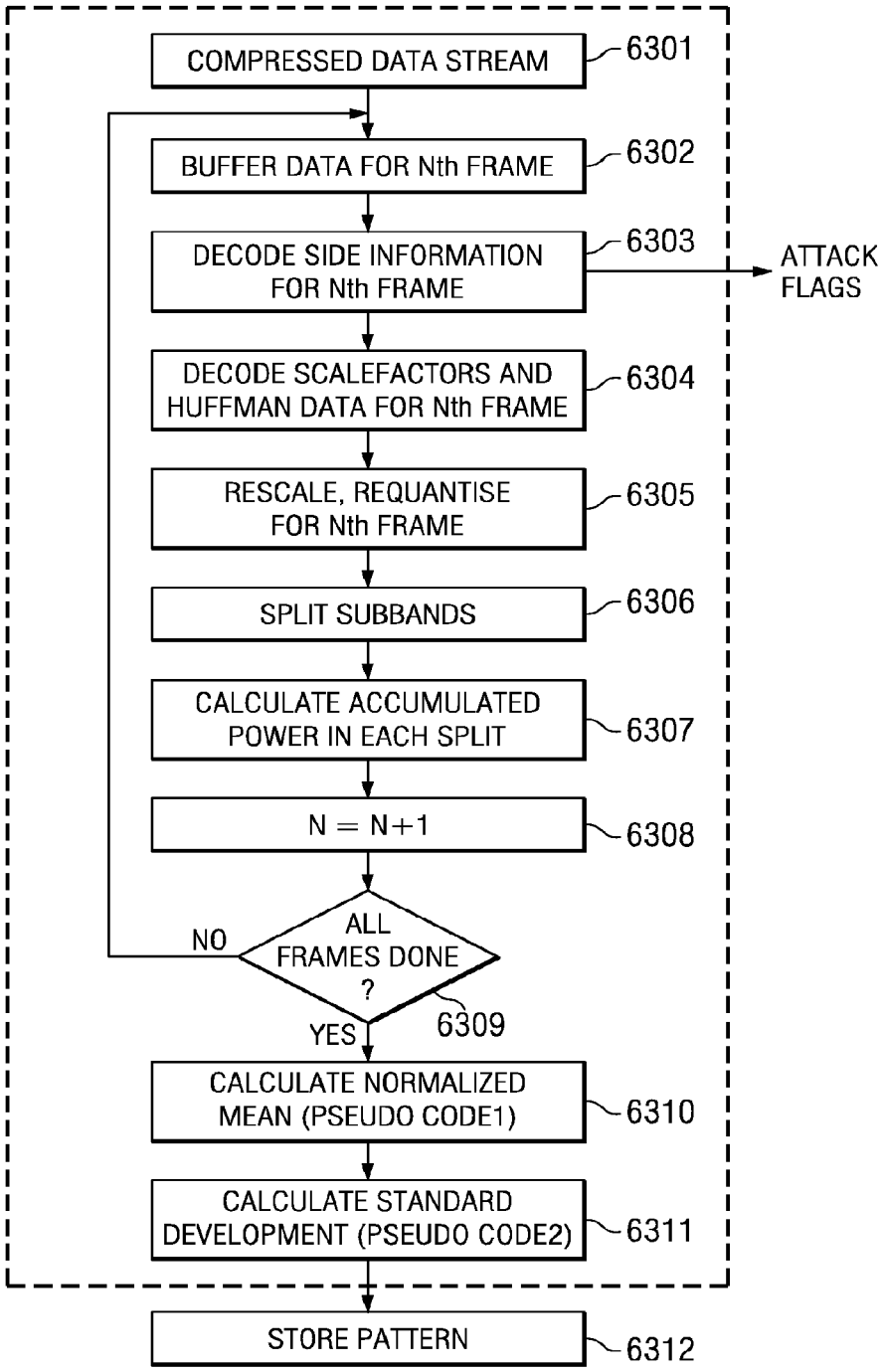
FIG. 7 is a flow chart illustrating the training process for getting the parameters of referenced compressed audio data files according to the present invention.

Referring to FIG. 7, the process summarized as the classification process in step 63 of FIG. 6 is illustrated. In step 6302, a frame of the audio file is placed in a buffer storage. In step 6303, the side-information is decoded to provide the attack flags. Steps 6304 and 6305 remove the file compression so that parameters can be generated that correspond to those resulting from the psycho-acoustic compression. In step 6306, the sub-bands are divided into split sub-bands and the power in the split sub-bands is calculated in step 6307. Steps 6308 and 6309 insure that all of the frames of the audio file are being included in the process. In step 6310, the normalized mean for the each split sub-band is calculated as indicated by the pseudo-code illustrated below. In step 6311, the standard deviation is calculated and the parameters stored in step 6312.

Referring to FIG. 8, the process for comparing two audio files is illustrated. In step 801, the weighted differences between the split sub-bands of two audio files is determined. In step 802, thresholding is applied. In step 803, the confidence levels are determined by the pseudo code following. The results are sent to the user in step 804.

Pseudo Codes

```
1. Mean calculations
{
 for all frames
     for all split sub-bands(s)
         meanPower[s]=Power[s]/numFrames;
     for all split sub-bands(s)
         normalized means[s]=meanPower[s]/{means[s]}max;
}
2. Standard Deviation calculations
{
for all frames
             for all split sub-bands(s)
                 stD^2[s]=(Power[s]-meanPower[s])/(numFrames-1);
         for all split sub-bands(s)
normalized stD[s]=stD[s]/{stD[s]}max;
         }
3. Thresholding and confidence level calculations
{
confidence_level=0
     for all split sub-bands(s)
             confidence_level = confidence_level + d*ws
where,
d=difference vector, formed by the difference between input signal and
reference signal. ws is the weighting vector for each sub-band.
For the lower sub-bands 0 and 1,
                 ws = a, if e ≦ Δ/2
                    = 0, if e > Δ/2
and for all other sub-bands,
                 ws = b, if e ≦ Δ/2
                    = 0, if e > Δ/2
```

The coefficients a and b have been calculated empirically, and a>b to account for the greater importance accorded by the human auditory system for lower frequency sounds.

The parameters used in the foregoing pseudo code are illustrated in FIG. 9.

Figures 10, 11:
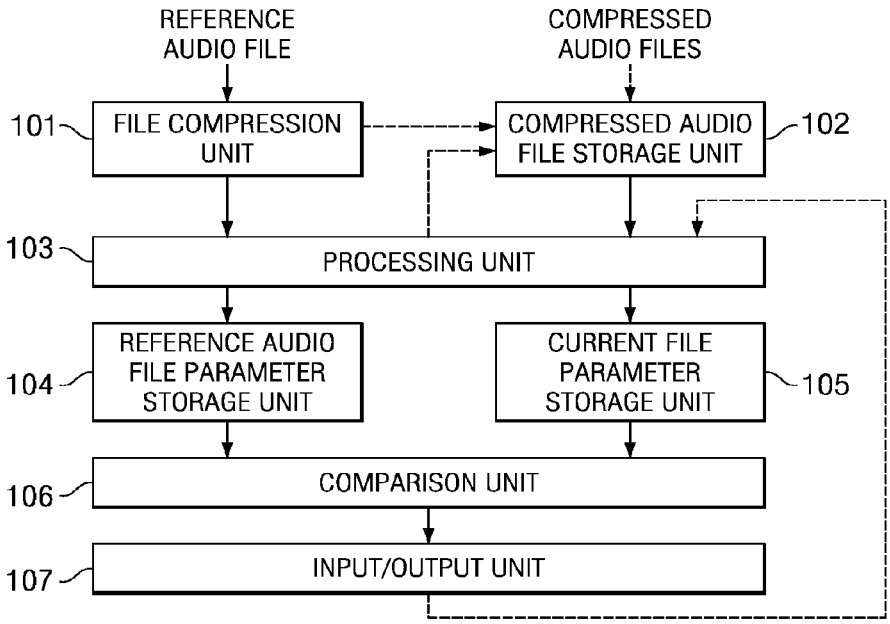
FIG. 10 illustrates apparatus capable of determining parameters for compressed audio files and for comparing compressed audio files according to the present invention.
FIG. 11 illustrates the result of applying the present procedures to a plurality of musical categories according to the present invention.

Referring to FIG. 10, apparatus for generating parameters characterizing an audio file and for comparing audio files according to the present invention. A (reference) audio file is applied to file compression unit 101. The file is compressed according to a psycho-acoustic algorithm. When the file is a reference audio file, the resulting compressed audio file is applied to processing unit 103. For audio files that are to be added to a library of compressed audio files, the psycho-acoustic compressed file is subjected to a second compression, a file compression to reduce the needed storage space. The audio files with the second (file) compression are stored in the compressed audio file library in compressed audio file storage unit 102. The files in the compressed audio file library could have been compressed elsewhere and the library unit 102 coupled to the apparatus of the present invention. In the processing unit 103, the compressed audio file is processed to provide parameters described above used to characterize the reference audio file. These parameters generated by the processing unit 103 are stored in the reference audio file parameter storage unit 104. In response to a signal generated by the input/output unit 107, the processing unit 103 retrieves a compressed audio file from the compressed audio file storage unit 102. In the processing unit 103, the retrieved compressed audio file is restored to the psycho-acoustic compressed file state. In this state, parameters corresponding to those generated for the reference audio file are generated and stored in the current audio file parameter storage unit 105. The parameters stored in the reference audio file parameter storage unit 104 and the parameters stored in the current audio file storage unit 105 are applied to comparison unit 106 wherein the comparison of the parameters is performed. The results of the comparison are applied to input/output unit 107. Depending on user inputs or user preferences, the current audio file can be identified and/or can be retrieved from the compressed audio file storage unit 102 for separate manipulation. Depending on the user inputs, the process can be repeated until all the files in the compressed audio file storage unit 102 have been examined or the process can be concluded at a point determined by a user input.

2. Operation of the Preferred Embodiment

The present invention can be understood as follows. An audio file is divided into frames in the time domain. Each frame is compressed according to a psycho-acoustic algorithm. The compressed file is then divided into sub-bands and each sub-band is further divided into split sub-bands. The power in each sub-band is averaged over all of the frames. The average power for each sub-band is then a parameter against which a corresponding parameter for a separate file can be compared. The parameters for all of the sub-bands are compared by determining a difference between the corresponding parameters. The accumulated difference between the parameters determines a measure of the similarity of the two audio files.

The foregoing procedure can be refined to provide a more accurate comparison of two files. Because the ear is sensitive to lower frequency components of the audio file, the difference between the powers in the individual split sub-bands of the first two sub-bands is determined rather than the average power in the sub-bands. Thus, greater weight is given to the power in the first two sub-bands. Similarly, empirical weighting factors can be incorporated in the comparison to refine the technique further.

In the psycho-acoustic compression, certain parameters referred to as attack parameters and related to the rhythm of the audio file are identified and included in side-information. These attack parameters can also be used to determine a relationship between two audio files.

Referring once again to FIG. 10, as will be clear to those skilled in that art, the function of many of the components shown as separate units can be performed by a processing unit having the appropriate algorithms available thereto.

One application of the present invention can be the search for similar audio files such as song files. In this situation, the parameters of the reference audio files are generated. Then the parameters of stored (and compressed) audio files are generated for comparison. However, stored audio files not only are compressed using a psycho-acoustic algorithm, but are compressed a second time to reduce the storage space required for the audio file. As will be clear, prior to determination of the parameters, the stored audio file must have the second compression removed.

The result of using the present invention to characterize and classify audio files in pop rock classical and jazz categories is shown in FIG. 11. In each case, the classification of the category with itself yielded a 90% correlation, a value that indicates essential equality of audio files. With the exception of the pop-jazz correlation, the correlation between categories is found to 30% or less, or essentially no correlation. The correlation between the jazz and the pop categories ranged from 30% to 70%. This correlation indicates no correlation to audio files that can be considered similar. This result is probably the result of the flexibility of or lack of precise classification of either the pop or the jazz category.

While the invention has been described with respect to the embodiments set forth above, the invention is not necessarily limited to these embodiments. Accordingly, other embodiments, variations, and improvements not described herein are not necessarily excluded from the scope of the invention, the scope of the invention being defined by the following claims.

What is claimed is:

1. A method of a processor for generating classification parameters for an audio file, the method comprising:

dividing the audio file into frames;

processing, in the processor, the audio file with a psychoacoustic algorithm;

compressing the audio file processed by the psychoacoustic algorithm to form a compressed audio file;

dividing each frame of the compressed audio file into sub-bands;

determining an average spectral power for each of the sub-bands for all of the frames, the average spectral power for each sub-band forming a set of parameters; and extracting attack information from side-information included with the compressed audio file frame, wherein the attack information in the side-information for each compressed audio file frame is treated as a classification parameter; and classifying the audio file according to the classification parameter.

2. The method as recited in claim 1 further comprising the step of using the set of parameters of the audio file to compare with a second set of corresponding parameters determined for a second audio file.

3. The method as recited in claim 2 further comprising comparing the audio file and the second audio file by determining a difference between the parameter of the audio file and the parameters of the second audio file.

4. The method as recited in claim 3 further comprising applying weighting factors to the difference in parameters.

5. The method as recited in claim 4 further comprising calculating a confidence level for the difference in parameters.

6. The method as recited in claim 2 further comprising the step of removing a second level of compression for the second audio file prior to determining the parameters of the second audio file.

7. The method as recited in claim 1 wherein the individual sub-bands of at least one of the lowest order sub-bands are parameters.

8. The method as recited in claim 1 further comprising the step of dividing the sub-bands of each frame into split sub-bands, the average spectral power of the split sub-bands being the audio file parameters.

9. An apparatus for generating parameters classifying an audio file, the apparatus comprising:

a psychoacoustic unit for processing an audio file;

a file compression unit, the file compression unit compressing an audio file processed by the psychoacoustic unit; and a processing unit coupled to the file compression unit, the processing unit dividing the compressed audio file into a plurality of frames, the processing unit determining the energy in each of a multiplicity of frequency sub-bands in each frame, the processing unit determining a normalized mean power for each sub-band in the frame, the normalized mean power of the sub-band being the parameters, and the processing unit extracting attack information from side-information included with the compressed audio file frame, wherein the attack information in the side-information for each compressed audio file frame is treated as a classification parameter and wherein the audio file is classified according to the classification parameter.

10. The apparatus as recited in claim 9 wherein the sub-bands are divided into split sub-bands, the normalized mean power being computed for all split sub-bands except for at least one of the lowest sub-bands, the normalized mean power for the split sub-bands and the power for the split sub-bands of at least one lowest sub-band being the parameters.

11. The apparatus as recited in claim 9 further comprising:

a storage unit storing a compressed stored comparison audio files and coupled to the processing unit, the processing unit calculating parameters for the stored comparison audio file;

a first parameter storage unit for storing the audio file parameters;

a second parameter storage unit for storing the audio file parameters; and a comparison unit for comparing the audio file parameters and the comparison audio file parameters.

12. The apparatus as recited in claim 11 wherein the comparison unit generates a difference between the audio file parameters and the comparison audio file parameters.

13. The apparatus as recited in claim 12 wherein the difference between the audio file parameters and the comparison audio file parameters is a weighted difference.

14. The apparatus as recited in claim 13 wherein the comparison unit generates a confidence parameter describing the relationship of the audio file to the stored comparison audio file.

15. The apparatus as recited in claim 13 wherein the sub-bands are divided into split sub-bands, the parameters being the normalized mean power for each of the split sub-bands except for a predetermined number of the lowest sub-bands, the split sub-bands being the parameters for the predetermined number of lowest sub-bands.

16. A method, of a processor, for classifying psycho-acoustic compressed audio files, the method comprising:

selecting a reference audio file, wherein the reference audio file has been compressed to a psycho-acoustic compressed state by dividing the audio file into frames and processing the audio file with a psychoacoustic algorithm;

forming a set of parameters for the reference audio file by dividing each frame of the reference psycho-acoustic compressed reference audio file into sub-bands and determining an average spectral power for each of the sub-bands for all of the frames;

selecting a library audio file, wherein the library audio file has been compressed to a psycho-acoustic compressed state by dividing the library audio file into frames and processing the audio file with a psychoacoustic algorithm;

forming a set of parameters for the library audio file by dividing each frame of the library psycho-acoustic compressed library audio file into sub-bands and determining an average spectral power for each of the sub-bands for all of the frames;

extracting attack information from side-information included with the reference audio file and with the library audio file, where the attack information in the side-information for each audio file frame is treated as a parameter; and computing, in the processor, a confidence level for similarity between the reference audio file and the library audio file by computing a difference between the parameters of the reference audio file and the parameters of the library file, and classifying the audio file according to the parameter.

17. The method as recited in claim 16 further comprising dividing the sub-bands of each frame of both the reference audio file and the library audio file into split sub-bands, the average spectral power of the split sub-bands being the respective audio file parameters.

18. The method as recited in claim 16 wherein computing the confidence level comprises applying weighting factors to the differences in parameters.

* * * * *